United States Patent [19]

Wexler et al.

[11] 4,406,296

[45] Sep. 27, 1983

[54] JEWELRY SYSTEM

[75] Inventors: Howard Wexler, 300 E. 40 St., New York, N.Y. 10016; Joseph Spano, Bronx, N.Y.

[73] Assignee: Howard Wexler, New York, N.Y.

[21] Appl. No.: 339,824

[22] Filed: Jan. 15, 1982

[51] Int. Cl.[3] ..... A44C 7/00

[52] U.S. Cl. ..... 132/148; 63/2; 63/14 R; 2/209.1; 132/53

[58] Field of Search ..... 63/1, 2, 3, DIG. 3, 63/DIG. 1, 21, 14 R; 132/46, 47, 53, 105, 148

[56] References Cited

U.S. PATENT DOCUMENTS

| | | | |
|---|---|---|---|
| 1,469,450 | 10/1923 | Stone | 132/148 |
| 3,724,470 | 4/1973 | Wilson | 132/46 R |
| 3,758,771 | 9/1973 | Frohardt et al. | 132/53 X |
| 3,895,797 | 7/1975 | Moore | 273/DIG. 30 |
| 3,898,868 | 8/1975 | Tomlinson | 63/2 |

FOREIGN PATENT DOCUMENTS

| | | | |
|---|---|---|---|
| 581363 | 9/1924 | France | 132/20 |
| 1217287 | 12/1959 | France | 132/47 |
| 267976 | 9/1929 | Italy | 63/2 |

*Primary Examiner*—F. Barry Shay

*Attorney, Agent, or Firm*—Davis, Hoxie, Faithfull & Hapgood

[57] ABSTRACT

A system of jewelry intended primarily though not exclusively for children incorporating an improved interconnectable bead. The improved interconnectable bead consists of a bead body having a male and a female connector and an opening through the bead body which is substantially perpendicular to an axis drawn through the male and female connectors. The bead body is strung on a string passed through the opening. The string ends are passed through a ring opening larger than the male connector and secured. The bead body may swivel freely until the male connector abuts the outer wall of the ring. If tension is applied to the string, the male connector will slip into the opening in the ring and thereby will be partially concealed. The improved bead may be used with hats and hair attachments and means for suspending it therefrom may be hook and loop fastening means.

13 Claims, 13 Drawing Figures

JEWELRY SYSTEM

BACKGROUND OF THE INVENTION

1. Field of the Invention

The present invention relates to a system of jewelry intended primarily though not exclusively for children incorporating an improved interconnectable bead which allows formation of necklaces and pendants, bracelets and pendants, and pendants heretofore not possible by connections of known interconnectable beads.

2. Description of the Prior Art

One basic problem with respect to any children's play jewelry system is that it must combine an adult look while eliminating features which while safe for adults would be unsafe for children. For example, pierced earrings while commonly worn by adults are generally considered unacceptable for small children. Adult jewelry covers a wide spectrum of shapes, colors, constructions and consequently different looks. In catering to a little girl's fantasies with regard to imitating the appearance of her older sister or her mother, a similar wide range of ornamental looks is necessary.

Probably no play jewelry system could cover all the possibilities of which a young girl might dream; however, no existing play jewelry system provides even a wide range of inexpensive and safe fashion looks. For example, various sets of interconnectable beads have been merchandised in a make-your-own-jewelry type of system, wherein the purchaser makes a bracelet or necklace out of purchased beads to suit his or her taste.

These interconnectable beads are plastic beads of various shapes, colors, and resilient materials with a male connector at one end and a female connector at the other end. Various size loops and lengths of strings may be constructed by connecting these interconnectable beads. Chains of beads may be made into loops of lengths suitable to be worn as a bracelet or as a necklace. The problem with such jewelry systems is that the variation possible is extremely limited. Typical interconnectable beads can only be connected to form strings or to form strings which may then be closed on themselves to form loops. It is not presently possible to form loops which have a branch or branches therefrom. Further, the known interconnectable bead systems are limited because they can be worn only as loops.

SUMMARY OF THE INVENTION

The present invention provides an improved interconnectable bead structure which can serve as the basis for an entire jewelry system of many ornamental configurations including chains and strings with branching configurations heretofore not possible using known interconnectable beads. The improved structure may readily be combined with safe supporting structure so that it may be worn as part of a pendant rather than as part of a loop. The improved structure consists of an interconnectable bead with a male connector at one end and a female connector at its other end. The body of the bead may be spherical, cylindrical or any other shape which is desired. In addition to the male and female connectors a hole through the body of the improved bead is formed. This hole is substantially perpendicular to an axis drawn through the male and female connectors. The hole is used to insert a string, wire or other flexible connecting means. The string passes through the hole and the body of the bead so that the bead is strung on the string and can swivel thereon. The ends of the string are then passed through a central opening in a second member, an opening slightly larger than the male connector of the bead. For example, the string ends may be passed through an appropriately sized opening in a typical noninterconnectable bead or a ring. After being passed through one or more narrow openings the string ends are fixedly connected so that they will not be pulled back through the opening or openings. In the preferred embodiment, this is accomplished by connecting these string ends to an object having a maximum cross-sectional area larger than the narrow opening. In the preferred embodiment, the length of the string is such that the interconnectable bead may swivel freely on the string until the male connector is positioned within the narrow opening through which the string passes. Once the male connector is so positioned, it will not slip out of position unless external tensile force is applied to move it therefrom. This construction including the tension which holds the male connector within the narrow opening contributes to an adult look by hiding the male connector from view while the jewelry construction is being worn. From a distance, this construction will not look like it is based upon an interconnectable bead. Various further embodiments will be discussed below.

DETAILED DESCRIPTION

Figure 1:
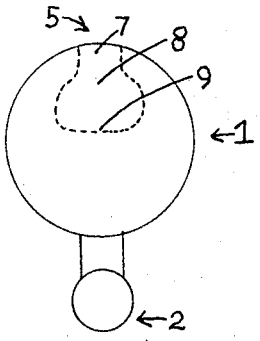
FIG. 1 illustrates an interconnectable bead known in the prior art.

FIG. 1 illustrates a typical prior art interconnectable bead 1 having male connector 2 consisting of a neck terminating in a plug and female connector 5. While bead 1 is shown as having a spherical main body, it is known in the prior art that the main body may be cylindrical or have various other shapes as desired. Chains and loops may be formed from a plurality of beads such as bead 1. Male connector 2 fits snugly into female connector 5 so that an interference fit is formed as described below. The bead body 1 is made of resilient material. The female connector 5 consists of a cavity 8 having a minimum-cross-section-portion 7 which is spaced from the inner end 9 of the cavity 8. The dimensions of the neck of the male connector 2 and cavity 8 of female connector 5 are chosen so that the plug of male connector 2 can be forced past the minimum-cross-section-portion of a bead having a similarly shaped female connector as bead 1. A bead having a similarly shaped male connector as that of bead 1 could be forced past the minimum-cross-section-portion 7 of bead 1.

Figure 2:
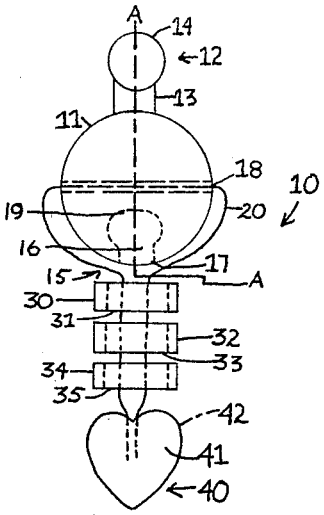
FIG. 2 illustrates a preferred embodiment of an improved interconnectable bead according to the present invention.

FIG. 2 illustrates a preferred embodiment of an improved interconnectable bead. FIG. 2 shows an improved interconnectable bead construction 10 having a bead body 11, a male connector 12, female connector 15, and opening 18 which passes through the bead body 11. Bead body 11 is made from a resilient material. Male connector 12 consists of a protruding neck 13 which terminates in a spherical plug 14. Female connector 15 consists of a cavity 16 having a minimum-cross-section-portion 17 spaced from the inner end 19 of the cavity 16. The minimum-cross-section-portion 17 is slightly smaller than the maximum cross-sectional area of spherical plug 14. The improved bead 10 also includes a flexible string 20, rings 30, 32, and 34, and pendant 40. String 20 passes through opening 18, so that the bead body 11 is strung on string 20. Opening 18 is substantially perpendicular to axis A—A which is the axis of the male and female connectors 12 and 15 respectively. The string 20 also passes through the openings 31, 33 and 35 of rings 30, 32 and 34 and is attached to pendant 40. The opening 31 is larger than the maximum cross-sectional area of spherical plug 14 while smaller than the maximum cross-sectional area of pendant 40. Further, while plug 14 is described as spherical it might be made in other shapes. The length of string 20 is such that when plug 14 is concealed, by rotating bead 11 from the position shown in FIG. 2 by 180° about the axis formed by opening 18 and inserting it into opening 31 of ring 30, string 20 provides tension which prevents plug 14 from slipping out of the opening 31. When plug 14 is not inserted into opening 31, the bead body 11 can swivel freely on string 20 until male connector 12 abuts the outer wall of ring 30. Tension must then be exerted on the string to enable plug 14 of connector 12 to slip over the body of ring 30 into its concealed position within the central opening 31.

In the preferred embodiment, several rings 30, 32, 34 are shown. In place of rings 30, 32 and 34, any desired body shape other than a ring may be used to achieve the benefits of the invention, as long as one body is used which has an opening large enough for insertion of spherical plug 14. Also, pendant 40 is shown as comprising two halves 41 and 42 with the ends of string 20 fixed between them. Halves 41 and 42 may be glued together or connected in any other suitable manner. It is contemplated that pendant 40 might consist of a single piece with the ends of string 20 affixed thereto.

Figure 3:
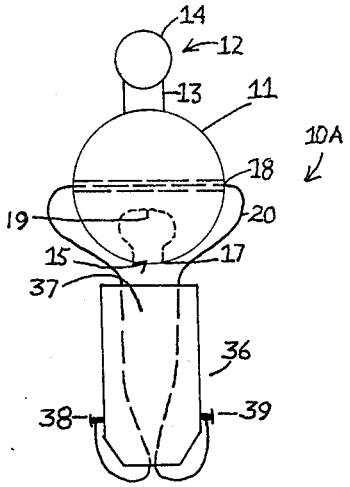
FIG. 3 illustrates a second embodiment of an improved interconnectable bead according to the present invention.

FIG. 3 shows a second embodiment of an improved interconnectable bead 10A which differs as discussed below from the preferred embodiment shown in FIG. 2. In FIG. 3, pendant 40 is eliminated and only a single ring 36 is shown. String 20 passes through opening 37 of ring 36 and is fixed to the ring so that the string cannot pull back through opening 37. As shown in FIG. 3, the ends of string 20 are affixed to studs 38 and 39 located in the outer wall of ring 36. The length of string 20 is chosen so that tension must be exerted to permit plug 14 to slip into opening 37.

Figure 3A:
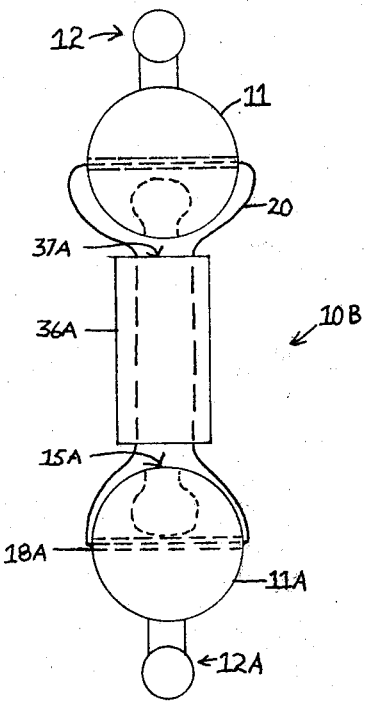
FIG. 3A illustrates a third embodiment of an improved interconnectable bead according to the present invention.

FIG. 3A shows a third embodiment of an improved interconnectable bead 10B which differs as discussed below from the preferred embodiment shown in FIG. 2. In FIG. 3A, pendant 40 is replaced by a second bead body 11A having male and female connectors 12A and 15A respectively and an opening 18A. The rings 30, 32 and 34 are replaced by a single ring 36A having an opening 37A. Opening 37A at each of its ends has a cross-sectional area slightly larger than the maximum cross-sectional area of the plugs 12 and 12A. As shown in FIG. 3A, string 20 passes through bead body 11, ring 36A, and second bead body 11A. The ends of string 20 are then tied together so that string 20 forms a loop of such a length that tensile force must be applied to place either or both of male connectors 12 and 12A into a concealed position within the ends of opening 37A. This third embodiment is particularly beneficial as providing a base unit from which a large variety of jewelry looks might be made. Both, one or neither of the male connectors 12 and 12A may be placed in a concealed position and each of the three alternatives results in a different starting block.

Figure 4:
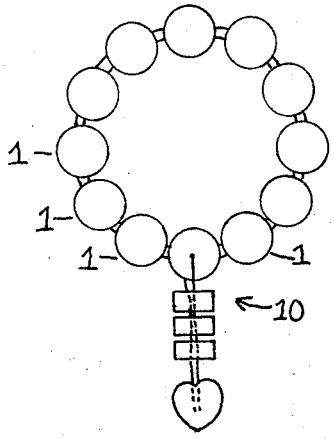
FIG. 4 illustrates a loop and a branching pendant constructed using prior art interconnectable beads and the improved interconnectable bead of FIG. 3.

The improved interconnectable beads as shown in FIGS. 2, 3 or 3A may readily be incorporated into many jewelry systems while the prior art interconnectable bead couly only be interconnected to form strings and loops. FIG. 4 shows a loop with a pendant and illustrates the additional branching capability added with the improved bead. FIG. 4 shows a plurality of prior art interconnectable beads 1 connected with an improved bead 10. This interconnection may be a bracelet with a pendant or a necklace with a pendant depending on the number of beads 1 used. More than one bead 10 or 10A may be used for additional branches and variety.

Figure 5:
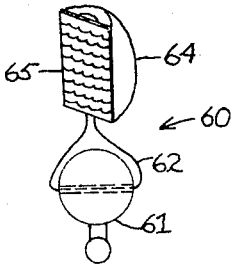
FIG. 5 illustrates a hook and loop fastener and bead construction used for hanging a jewelry construction including the improved interconnectable bead of either FIG. 2 or FIG. 3.

FIG. 5 illustrates a hook and loop fastener and bead apparatus 60 which is interconnectable with the improved bead of FIGS. 2, 3 or 3A. These beads may be the basis of a number of fashion jewelry systems if a means for hanging them is provided. The apparatus 60 is one such means. Apparatus 60 consists of an interconnectable bead 61 strung on a string 62. The ends of string 62 are fixed to a body 64. Body 64 also has attached to it a patch 65 of hook and loop fastener material such as that sold under the trademark "Velcro."

Figure 6:
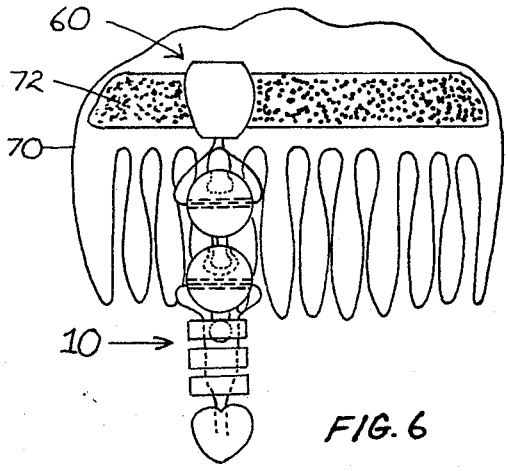
FIG. 6 illustrates another structure for hanging jewelry constructions consisting of a fashion hair comb with an attached strip suitable for fastening to hook and loop fasteners.
Figure 7:
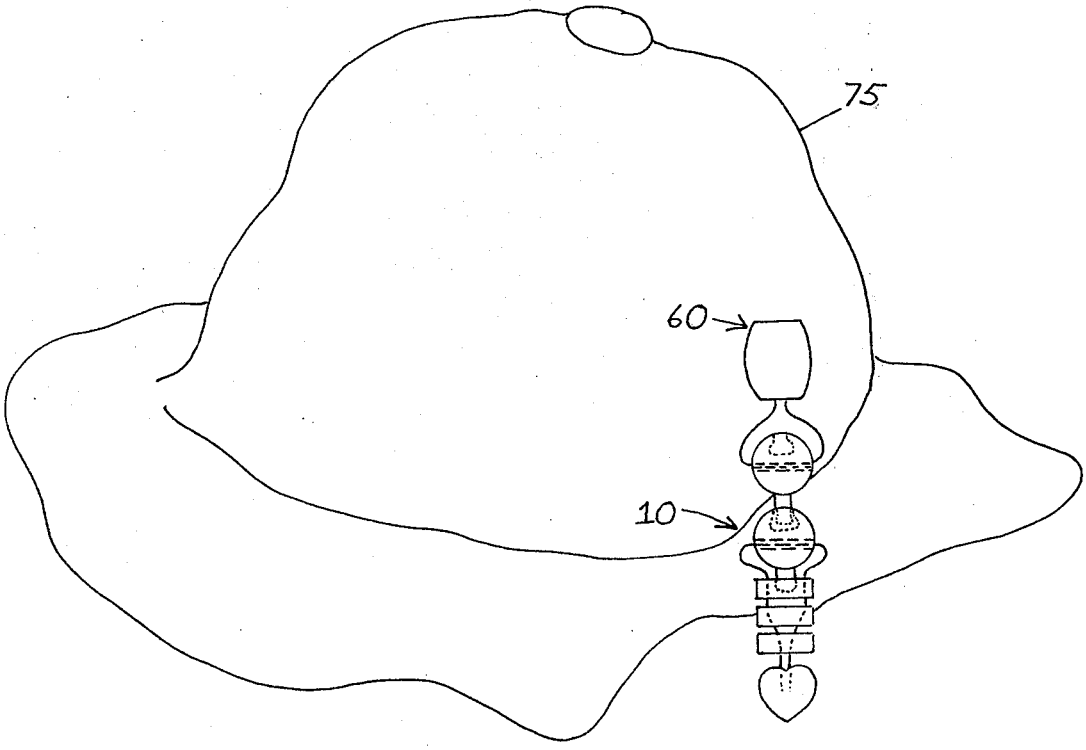
FIG. 7 illustrates a fashion system including a felt hat in conjunction with the bead construction of FIG. 5 and the improved interconnectable bead of FIG. 2.
Figure 8:
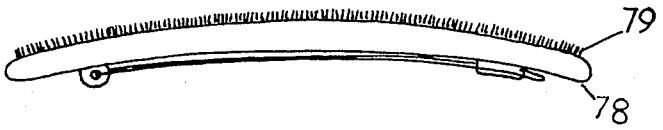
FIG. 8 illustrates a barrette with an attached strip suitable for fastening to hook and loop fasteners.

FIGS. 6 and 7 show improved bead 10 and apparatus 60 combined as part of a fashion system. FIG. 6 shows a fashion hair comb 70 with an attached strip of material 72 which is suitable for fastening to hook and loop fastener material. Hanging from the strip of material 72 are apparatus 60 and improved bead 10 which are connected together. FIG. 7 shows apparatus 60 and improved bead 10 connected together and hanging from felt hat 75. Felt is a surface to which the hook and fastener material 65 of apparatus 60 can readily connect. FIG. 8 shows another possible base for supporting apparatus 60 consisting of a barrette 78 with an attached strip of material 79 like the material 72 of FIG. 6.

Figure 9:
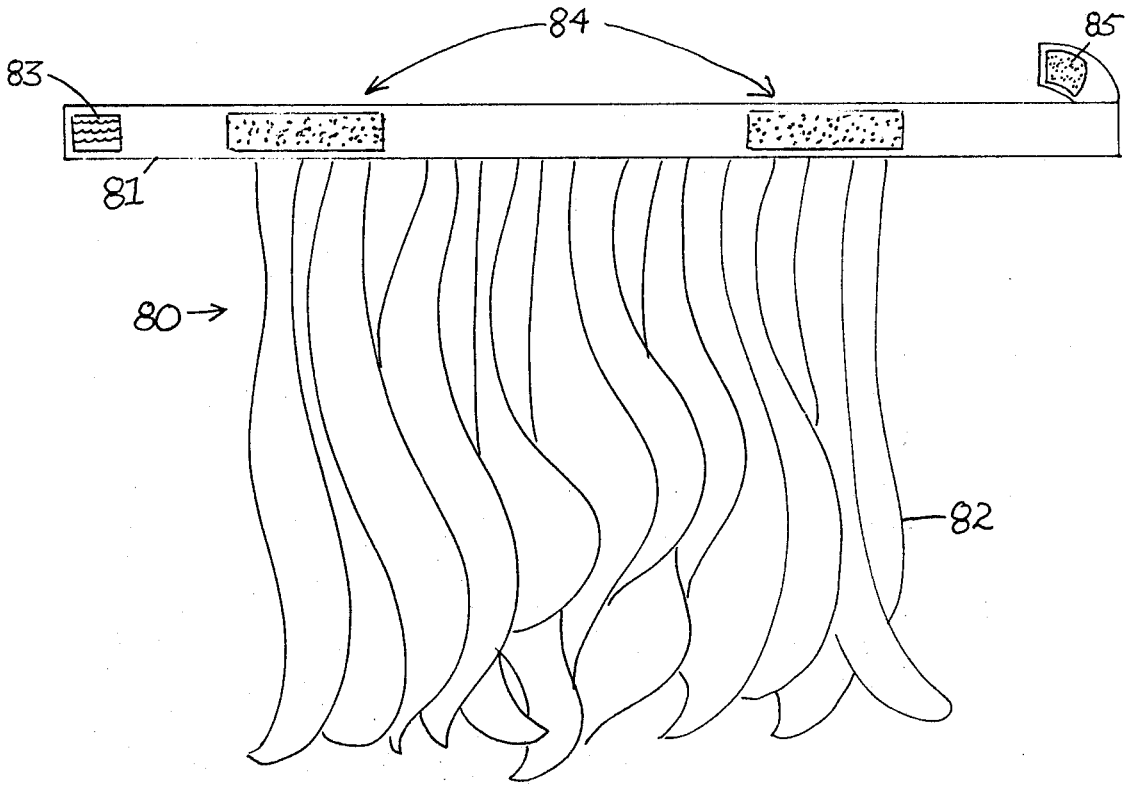
FIG. 9 illustrates a headband wig which in conjunction with the bead construction of FIG. 5 is suitable for supporting the improved beads of FIGS. 2 or 3.

FIG. 9 shows a headband 80 which has artificial hair 82 attached over a portion of the length of a strip 81 and a patch of hook and loop fastener material 83 at one end of the strip 81. On the same side of strip 81 as material 83 and at points somewhere between the ends of strip 81 are patches of material 84 which are suitable for fastening to hook and loop material. On the other side of strip 81 and at the other end of the strip from which material 83 is attached, another patch of material 84 suitable for fastening to hook and loop material is attached to strip 81. Headband 80 is worn by looping the strip 81 about the head and connecting the patches 83 and 85. One or more apparatus 60 may be connected to headband 80 using patch 84 or comb 70 or barrette 78 may be worn in the artificial hair 82. If a hat such as hat 75 is worn in conjunction with headband 80, a pleasing wig look is achieved and one or more pendant combinations of apparatus 60 and improved bead 10, 10A or 10B may be suitably attached to hat 75 to suit the taste of the wearer. FIGS. 6, 7, 8 and 9 have illustrated various alternatives for supporting the apparatus 60 of FIG. 5 which is interconnectable with the improved beads 10, 10A and 10B.

Figure 11:
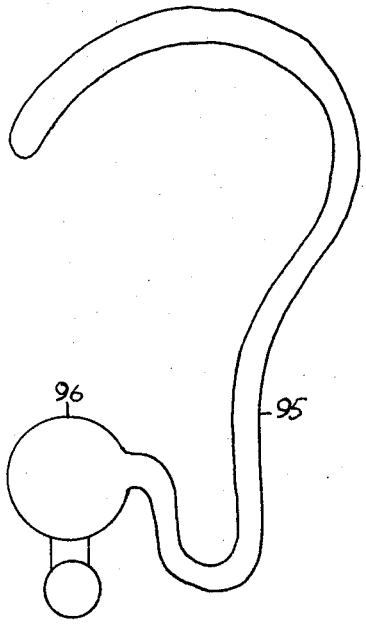
FIG. 11 illustrates an earloop and bead construction used for hanging jewelry constructions including the improved interconnectable bead of either FIG. 2 or FIG. 3.
Figure 10:
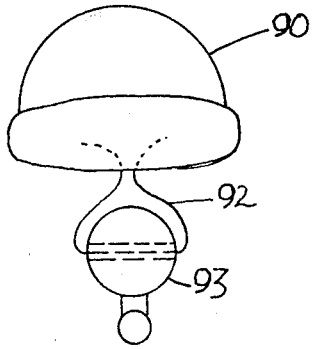
FIG. 10 illustrates a jewelry pin and bead construction used for hanging jewelry constructions including the improved interconnectable bead of either FIG. 2 or FIG. 3.

FIGS. 10 and 11 illustrate two bases of support for improved beads 10, 10A and 10B which do not rely on the apparatus 60 of FIG. 5. FIG. 10 shows an ornamental jewelry pin 90 having a clasp which is not shown. Pin 90 is attached to a string 92 which passes through an interconnectable bead 93. Bead 93 has male and female connectors suitable for connection to the improved beads. FIG. 11 shows an interconnectable bead 96 molded or otherwise mounted on an earshaped loop 95, for example, of plastic covered wire. By attaching a bead 10, 10A or 10B to bead 96, a jewelry system having an earring look is achieved without the necessity of a wearer having pierced ears. The precise shape of loop 95 can be altered by the child or the child's parent to achieve a precise fit. Once the loop is inserted over the ear it is relatively inconspicuous, permitting the child to pretend she is wearing real earrings.

Figure 12:
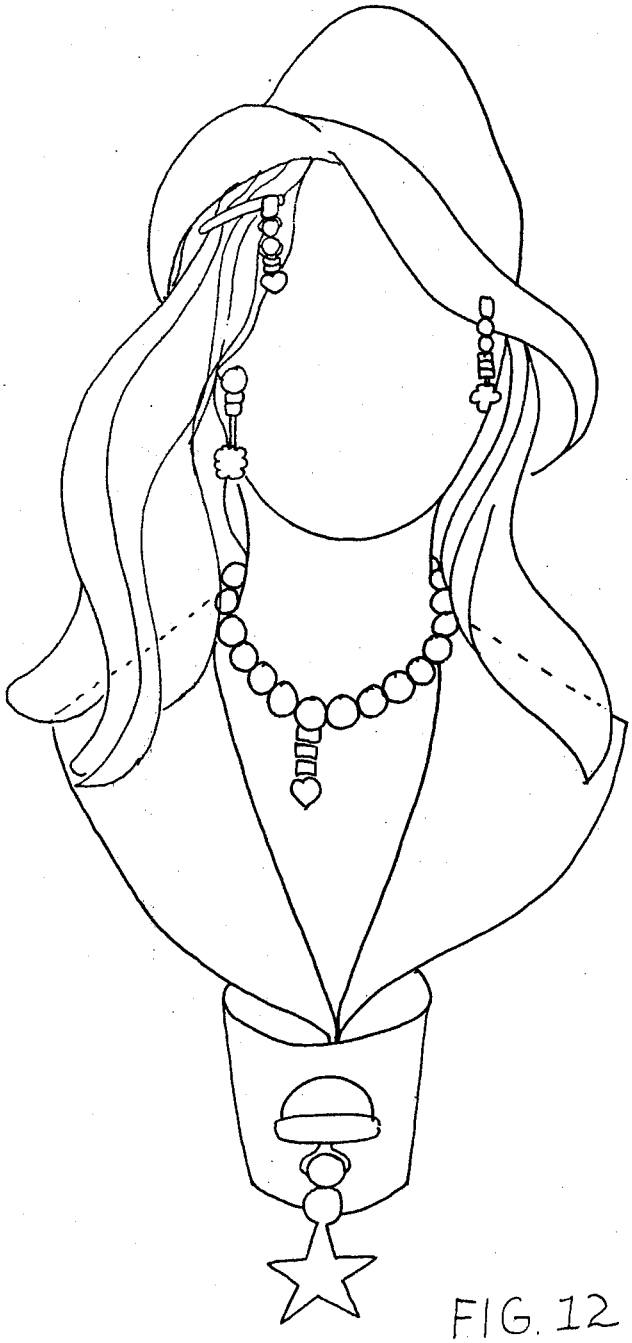
FIG. 12 illustrates one way in which the various parts of a jewelry system incorporating several of the parts shown in FIGS. 2–11 may be combined.

Various parts of an entire jewelry system based upon the improved beads of FIGS. 2, 3 and 3A have been discussed in conjunction with FIGS. 2–11. While various means of connecting improved beads 10, 10A and 10B into a jewelry system have been shown, other alternatives are available. For example, a male or female connector of a size suitable for connection to the bead body of bead 10, 10A or 10B might be molded to haircomb 70, barrette 78 or ear loop 95. FIG. 12 shows one way several of these various parts of the system may be combined in necklaces, pins, hair ornaments and the like and illustrates that the system of the present invention provides a greatly increased variety and number of fashion looks for children which are based upon safe and inexpensive components. It is noteworthy that with the exception of pin 90 of FIG. 10, all the parts of the jewelry system shown in FIG. 12 make use of connection and support means which are not sharp.

We claim:

1. A swivel bead jewelry construction comprising:

(a) a bead body of resilient material having (i) a protruding male connector comprising a neck terminating in a plug, (ii) a female connector opposite the male connector and comprising a cavity opening into said body having a minimum-cross-section-portion spaced from the inner end thereof, the dimensions of the plug and cavity being chosen so that the plug can be forced past the minimum-cross-section-portion of a cavity of a similarly shaped female connector and a similarly shaped male connector could be forced past the minimum-cross-section-portion of the cavity, (iii) an opening therethrough, the opening being oriented substantially perpendicular to the axis of the male and female connectors, (b) a ring whose central opening is larger than the maximum cross-sectional area of the plug, and (c) a string passing through the opening in the bead body and the ring and being attached to the ring, the length of the string being predetermined so that when the bead body is rotated about the string extending therethrough so that the male connector approaches the ring, tension must be exerted on the string to enable the plug to slip over the body of the ring into the central opening thereof.

2. A swivel bead jewelry construction comprising:

(a) a bead body of resilient material having (i) a protruding male connector comprising a neck terminating in a plug, (ii) a female connector opposite the male connector and comprising a cavity opening into said body having a minimum-cross-section-portion spaced from the inner end thereof, the dimensions of the plug and cavity being chosen so that the plug can be forced past the minimum-cross-section-portion of a cavity of a similarly shaped female connector and a similarly shaped male connector could be forced past the minimum-cross-section-portion of the cavity, (iii) an opening therethrough, the opening being oriented substantially perpendicular to the axis of the male and female connectors, (b) a ring whose central opening is larger than the maximum cross-sectional area of the plug, (c) an end element having a cross-sectional area larger than the ring opening, and (d) a string passing through the opening in the bead body and the ring and being attached to the end element, the length of the string being predetermined so that when the bead body is rotated about the string extending therethrough so that the male connector approaches the ring, tension must be exerted on the string to enable the plug to slip over the body of the ring into the central opening thereof.

3. A jewelry construction as described in claim 2, wherein the end element comprises a pendant having two halves which are connected together and the ends of the strand are fixed between the two halves of the pendant.

4. A jewelry system comprising:

a jewelry construction having (a) a bead body of resilient material having (i) a protruding male connector comprising a neck terminating in a plug, (ii) a female connector opposite the male connector and comprising a cavity opening into said body having a minimum-cross-section-portion spaced from the inner end thereof, the dimensions of the plug and cavity being chosen so that the plug can be forced past the minimum-cross-section-portion of a cavity of a similarly shaped female connector and a similarly shaped male connector could be forced past the minimum-cross-section-portion of the cavity, (iii) an opening therethrough, the opening being oriented substantially perpendicular to the axis of the male and female connectors, (b) a ring whose central opening is larger than the maximum cross-sectional area of the plug, (c) an end element having a cross-sectional area larger than the ring opening, and (d) a string passing through the opening in the bead body and the ring and being attached to the end element, the length of the string being predetermined so that when the bead body is rotated about the string extending therethrough so that the male connector approaches the ring, tension must be exerted on the string to enable the plug to slip over the body of the ring into the central opening thereof, and means to hang the jewelry construction.

5. A jewelry system as described in claim 4, wherein the means to hang the jewelry construction comprises a plurality of interconnectable beads which have male and female connectors like those of the first bead body of the jewelry construction whereby the plurality of interconnectable beads and the first bead body are connected together to form an ornamental chain and pendant which may be hung as a bracelet or necklace.

6. A jewelry system as described in claim 4, wherein the means to hang the jewelry construction comprises support means and means to connect the jewelry construction to the support means.

7. A jewelry system as described in claim 6, wherein the support means comprises an object, which can be fixed in a person's hair such as a decorative hair comb or a barrette, having affixed to it a strip of material suitable for connection with hook and loop fastener material and the means to connect the jewelry construction to the support means comprising a patch of hook and loop fastener material attached to one of the bodies of the jewelry construction.

8. A jewelry system as described in claim 6, wherein the support means comprises an ornamental pin including a clasp by which the ornamental pin may be fastened to clothing and the means to connect the jewelry construction to the support means comprises an interconnectable bead connected to the ornamental pin and having a male and female connector like those of the first body of the jewelry construction.

9. A jewelry system as described in claim 6, wherein the support means comprises a felt hat and the means to connect the jewelry construction to the support means comprises a patch of hook and loop fastener material attached to one of the bodies of the jewelry construction.

10. A jewelry system as described in claim 6, wherein the support means comprises a flexible earshaped loop and the means to connect the jewelry construction to the support means comprises an interconnectable bead affixed to the earshaped loop and having a male and a female connector like those of the first body of the jewelry construction.

11. A jewelry system as described in claim 6, wherein the support means comprises a head band comprising a strip of material with a patch of hook and loop fastener material at one end, a first patch of material suitable for connection to the fastener material at the other end, and a second patch of material suitable for connection to the fastener material located between the two ends of the strip of material, and the means to connect the jewelry construction to the support means comprises a patch of hook and loop fastener material affixed to a body, a flexible strand having two ends attached to the latter body, and a bead having a male and a female connector interconnectable with those of the first body of the jewelry construction strung on the flexible strand.

12. A jewelry system as described in claim 11, wherein the bead band includes artificial hair attached over a portion of the length of the strip of material.

13. A swivel bead construction comprising: a first body having a protruding male connector, a female connector comprising a cavity opening into said body having a minimum-cross-section-portion spaced from the inner end thereof, the dimensions of the plug and cavity being chosen so that the plug can be forced past the minimum-cross-section-portion of a cavity of a similarly shaped female connector and a similarly shaped male connector could be forced past the minimum-cross-section-portion of the cavity and an opening through the bead body, a second body having attached thereto a patch of hook and loop fastener material, and a string, wherein the string passes through the opening in the first body so that the first body is strung on the string and the ends of the string are attached to the second body.

* * * * *

UNITED STATES PATENT AND TRADEMARK OFFICE

CERTIFICATE OF CORRECTION

PATENT NO. : 4,406,296

DATED : September 27, 1983

INVENTOR(S) : Howard Wexler

It is certified that error appears in the above-identified patent and that said Letters Patent are hereby corrected as shown below:

Col. 4, line 41: change "couly" to --could--

Col. 5, line 14: change "material 84" to --material 85--

Signed and Sealed this

*Third* Day of *January 1984*

[SEAL]

*Attest:*

GERALD J. MOSSINGHOFF

*Attesting Officer*

*Commissioner of Patents and Trademarks*